US005592751A

United States Patent [19]

Guggemos et al.

[11] Patent Number: 5,592,751

[45] Date of Patent: Jan. 14, 1997

[54] DRYER SECTION HAVING COMBINATION OF SINGLE AND DOUBLE TIER DRYER GROUPS

[75] Inventors: Adolf Guggemos, Heidenheim; Markus Oechs Le, Bartholomae, both of Germany

[73] Assignee: Voith Sulzer Papiermaschinen GmbH, Germany

[21] Appl. No.: 440,087

[22] Filed: May 12, 1995

Related U.S. Application Data

[63] Continuation-in-part of Ser. No. 344,736, Nov. 23, 1994.

[51] Int. Cl.[6] ..... F26B 11/02

[52] U.S. Cl. ..... 34/117; 34/120; 162/197

[58] Field of Search ..... 34/117–19, 122–24, 34/110–13; 162/197, 271, 275

[56] References Cited

U.S. PATENT DOCUMENTS

| | | | |
|---|---|---|---|
| 3,658,642 | 4/1972 | Keyes, IV et al. | 162/197 |
| 4,447,964 | 5/1984 | Gardner | 34/119 |
| 5,279,050 | 1/1994 | Törmänen | 34/117 |
| 5,283,960 | 2/1994 | Sims et al. | 34/117 |
| 5,416,980 | 5/1995 | Ilvespaa | 34/117 |

*Primary Examiner*—Henry A. Bennett
*Assistant Examiner*—Steve Gravini
*Attorney, Agent, or Firm*—Ostrolenk, Faber, Gerb & Soffen, LLP

[57] ABSTRACT

A drying section for a paper making machine. The drying section includes a plurality of single-tier dryer groups, optionally followed by one or more double-tier groups. To control curl in the final paper product, a moistening device extending over the width of the drying section is provided near the end of the single-tier dryer groups. The moistening device can be divided into various zones to control the profile of the paper. Alternatively, or in addition to the moistening device, a contact-less dryer such as a infrared dryer can be provided after the dryer section, upstream of a calender section of the paper making machine. The moistening device can be provided to moisten the bottom or, optionally, the top side of the paper web. Where a double-tier dryer group is provided, to control curl the upper drying cylinders and the lower cylinders can be provided with different steam pressures to control curl. Alternatively, each of the cylinders can be individually controlled.

15 Claims, 12 Drawing Sheets

41
40
30
9
S
17
VIII
51
31
16
51B
51A
31a
31b

DRYER SECTION HAVING COMBINATION OF SINGLE AND DOUBLE TIER DRYER GROUPS

BACKGROUND OF THE INVENTION

This application is a Continuation-In-Part of co-pending U.S. application No. 08/344,736 filed Nov. 23, 1994.

The present invention relates to a drying section for drying a traveling fiber web, particularly a paper web. The drying section is preferably part of a paper manufacturing machine. Various drying sections of this type are known, for example, from U.S. Pat. No. 5,311,672 and from Federal Republic of Germany Patent Publication No. 43 28 554 A1.

From these publications it is known to divide a drying section into several successive drying groups. Any one of the drying groups can be developed either as a single-felt drying group or as a two-felt drying group. In one known variant, all drying groups are developed as single-felt drying groups, for instance in the manner that all cylinders have the felt on their top so that the bottom side of the web always comes into contact with the cylinders.

The foregoing arrangement affords the following advantages: The web to be dried is supported and guided continuously by a support belt ("drying wire" or "felt"), at least within each individual drying group. Unsupported lengths of web are thus avoided so that even with extremely high paper web speeds (on the order of up to 2000 meters/min), fluttering of the web is avoided and the danger of the web tearing is considerably reduced. At the transfer zones between adjacent drying groups, there is the option of either avoiding an unsupported (open draw) section of web or of providing a short unsupported length of web. If, in rare cases, the web should nevertheless tear, the torn web pieces (broke) can be easily removed by the force of gravity, due to the fact that all cylinders are top felted.

For the manufacture of certain types of paper it is disadvantageous to dry the paper web solely from one side. The two sides of the finished web may have slightly different characteristics. This results in a tendency to curl, i.e. the edges of the finished web or the edges of sheets of paper (produced from the web) do not lie flat, but bend downward or upward. The paper generally curls towards the side which was dried indirectly, i.e. the side which was in contact with the felt rather then the dryers.

So-called mixed or composite drying sections are also known in which at least one two-felted drying group is provided downstream of several single-felted drying groups. The final drying of the paper web generally takes place in the two-felt drying group, the two sides of the web alternately contacting the drying cylinders. With this arrangement, for numerous types of paper, the tendency to curl is substantially reduced or even completely eliminated. From several United States patents it is known, in the case of such a two-felt drying group serving for the final drying, to control the supply of thermal energy to an upper row of cylinders independently of the supply of thermal steam energy to the lower cylinders. In this way, the tendency of the final paper to curl is also prevented or reduced.

The known measures described above may be sufficient for the manufacture of numerous types of paper. In many cases, however, it is desired to counteract the tendency of the final paper to curl with even greater certainty.

SUMMARY OF THE INVENTION

It is an object of the present invention to meet the aforementioned objectives.

Another object of the invention is to provide a drying section which intentionally imparts to the final web a certain tendency to curl towards a given side. This may be necessary when the two sides of the paper are moistened to a different extent during printing on the final paper product, i.e. during the final use of the paper.

The following considerations and discoveries have led to the present invention: In a dryer section having single-felt drying groups (particularly if all single-felt drying groups have the felt on top), the side of the paper coming into contact with the cylinders is heated more vigorously and therefore dries more rapidly. Therefore, this side of the paper (generally the bottom side of the web) also tends to shrink sooner than the opposite side (as a rule the top side of the web). As a result, a compressive stress is produced in the side of the paper which is dried later in time while a tensile stress develops in the side of the paper which has already dried more strongly. This effect becomes stronger and stronger during the course of the drying process until the one side (as a rule the bottom side of the web) is completely dry. At times, a tendency to curl resulting from this effect can be noted already in this state.

However, toward the end of the drying process, generally the side of the web which was initially dried with delay becomes also completely dry. It can then be noted, in many cases, that the tensile and compressive stresses on the two sides of the paper are reversed so that now there is a tendency of the finished paper to curl in the other direction.

One important idea of the invention is that the side of the paper which dries faster and earlier is intentionally wetted during the drying process. In this way, it is possible to prevent the development of different, opposing tensile and compressive stresses on the two sides of the paper.

In accordance with a first aspect of the invention, a moistening device which is able to supply moisture to the web is provided in a region at the end zone of the drying section. This device can be a water spray device, a steam blow box or similar device. The moistening device may extend over the entire width of the web or over a portion of the web e.g. the edges. It can be subdivided over the width of the web into individually controllable zones, each of which can serve different purposes.

For example, the device serves to correct the transverse profile of the dry solid content of the web and/or to correct a varying or different tendency to curl over the width of the machine. It can happen that there is a greater tendency to curl at the edges of the web than in the middle of the paper web. This results from a difference in the amount of transverse shrinkage. In this case, therefore, the edges of the web will be moistened more intensively than the center of the web. Then it may be sufficient to provide only small moistening devices at the edges of the web rather than one which extends over the entire width of the web.

In accordance with another aspect of the invention, at least one additional contact-less dryer, for instance an infrared dryer, is arranged behind, that is downstream of the single-felt drying groups.

The moistening device can be arranged at different places along the paper making machine. A preferred place is adjacent one of the guide rolls of a single-felt drying groups, e.g. located within the last third of the drying section, as viewed alongside the entire drying section. Another possible location is between the end of the drying section and a following calender. In this case, it is advantageous for at least one of the calender rolls to be a heatable roll. Still another possible location is the space between two successive calenders. Several moistening devices which are preferably distributed over the above-mentioned places can also be provided. Preferably, one or more contact-less dryers will also be arranged between the drying section and the following calender and/or between two calenders.

In all of the aforementioned embodiments of the invention, the drying section can be constructed to consists only of single-felted drying groups. As an alternative, one or more double-felt drying groups can also be provided in the end region of the drying section.

In accordance with a third aspect of the invention, in order to reduce the tendency of the final web to curl, at least one double-felt drying group is provided in the end region of the drying section, in which group the drying rate of at least one of the upper cylinders can be adjusted independently of the drying rate of at least one of the lower cylinders. There are many possibilities for achieving this purpose:

a) Particularly in the initial region of the double-felt dryer group (or of the two-felt drying groups), the feeding of steam energy to at least one of the upper cylinders can be controlled independently of the feeding of steam energy to at least one lower cylinder. Thus, the top side of the web can be brought into contact with more strongly heated cylinders than the bottom side of the web. This measure is particularly effective in the case of many types of paper especially at the beginning of the two-felt (double-felt) drying group or groups in order to reduce the tendency of the finished paper to curl.

b) In drying particularly sensitive types of paper it is, however, advantageous to supply heat energy to each of the cylinders of the two-felt drying group or groups in an individually controllable manner. In this way, the supply of heat energy can be increased or reduced from cylinder to cylinder depending on the individual requirements of the final paper product.

c) Another solution involves establishing different felt tensions on the top and bottom cylinders in the two-felt drying group (or two-felt drying groups). The longitudinal tension in at least one lower felt is preferably set at a higher value, so that the surface pressure between paper web and cylinder surface is increased on the lower cylinders in order to thereby increase the transfer of heat from the lower cylinders to the top side of the web.

d) A further solution involves increasing the drying rate of the lower cylinders of the two-felt drying group by installing, in known manner, condensate disturbance ledges in at least one of the lower cylinders. The construction and action of such disturbing ledges is described in U.S. Pat. No. 4,282,656, the contents of which are incorporated by reference herein.

All the embodiments of the invention which have been described can furthermore also have the feature that most of or all of the guide suction rolls in the single-felt drying group are free of internal stationary suction boxes. In this connection, the vacuum necessary within the perforated suction rolls is preferably produced by means of an external stationary suction box in each case. This measure is preferably combined with a relatively large diameter suction rolls and/or with relatively large spacings between the suction roll and the two adjacent cylinders. In this way, there is obtained a relatively long evaporation path comprising a joint run of the paper web and the felt between the two cylinders (in order to increase the drying rate). Also the arrangement provides a sufficient space and a sufficiently long travel path of the web for the arrangement or effectiveness of the aforementioned moistening device.

Other features and advantages of the present invention will become apparent from the following description of the invention which refers to the accompanying drawings.

BRIEF DESCRIPTION OF THE DRAWINGS

Various embodiments of the invention are shown in the accompanying drawings. Each of FIGS. 1 to 7 is a diagrammatic side view of a drying section of a paper making machine.

DETAILED DESCRIPTION OF THE INVENTION

Figure 1:
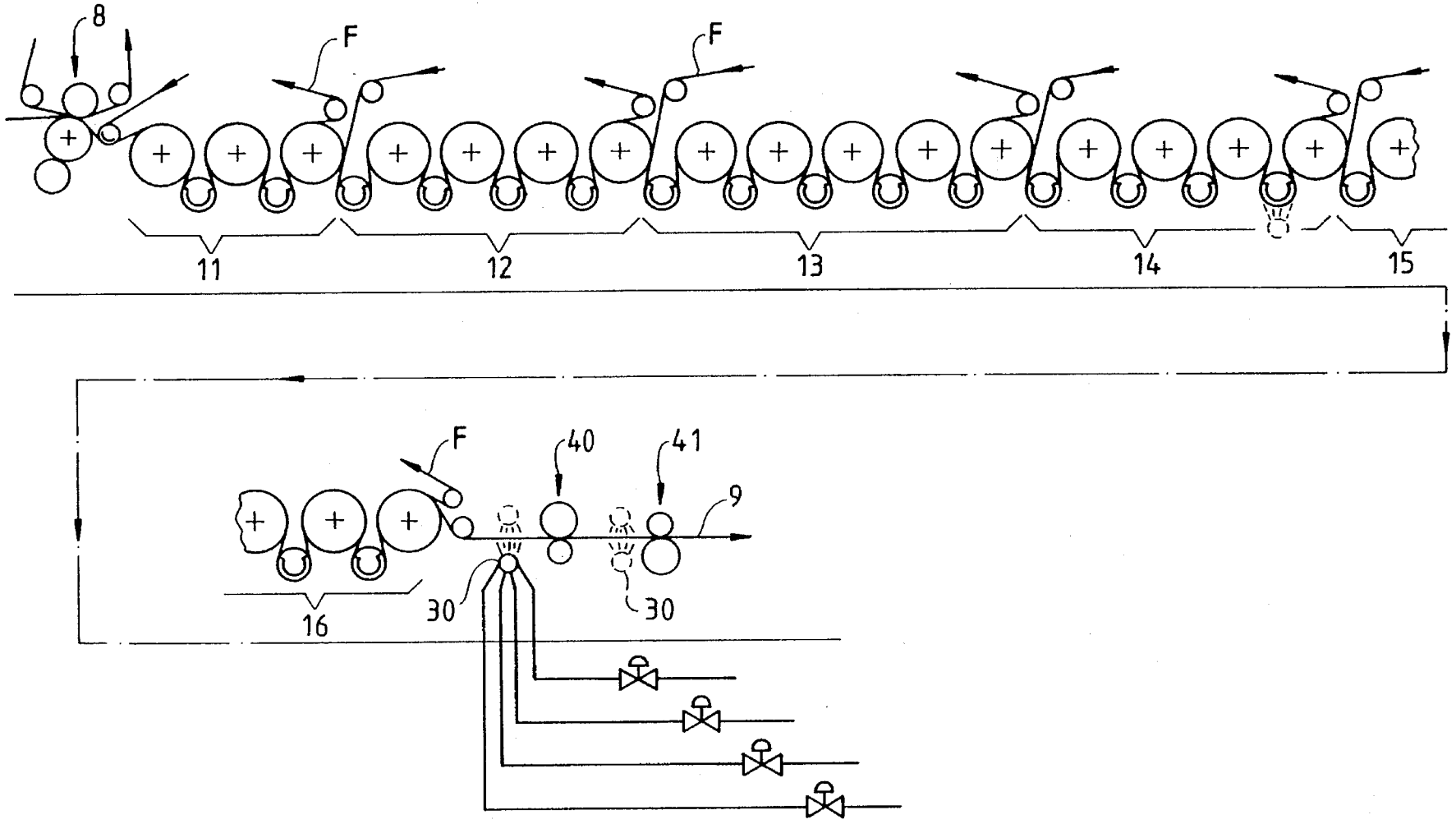
Figure 2:
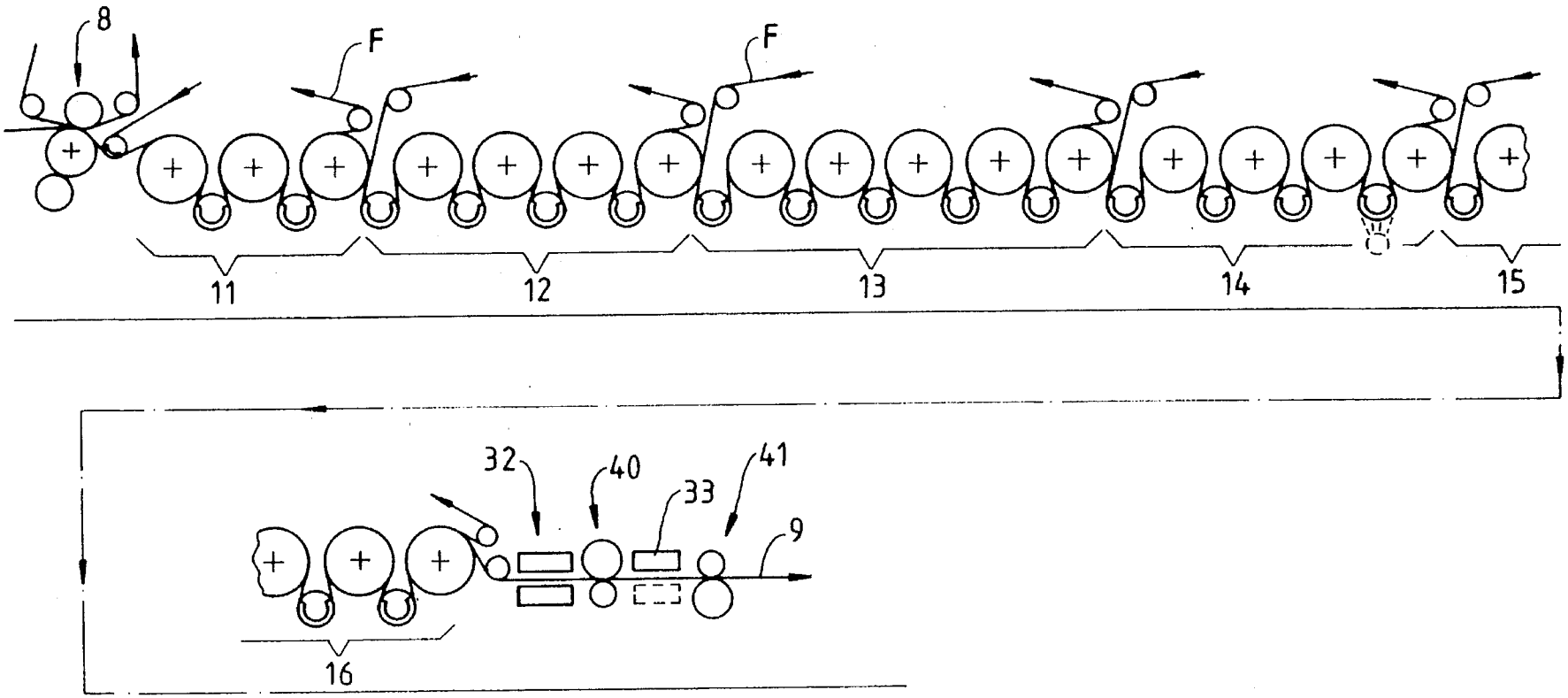

FIGS. 1 and 2 show a drying section consisting exclusively of single-felt drying groups (11–16) with felts F wrapping the tops of the drying cylinders. Also shown is a wet press (8) arranged upstream of the drying section and two calenders (40, 41) arranged downstream of the drying section. In accordance with FIG. 1, moistening devices (30) are provided and in accordance with FIG. 2 additional contact-less dryers, for instance infrared dryers (32, 33), are provided.

The moistening device 30 can have a water feed which can be controlled zone-wise, along the width of the paper web. Furthermore, depending on the production conditions of the paper, moistening devices can also be used for moistening the top side of the paper. This is true, in particular, when calenders (40, 41) are used, where, depending on the direction of tendency to curl, the wetting can be effected either on the top side, in front of the first nip or on the bottom side in front of the second nip, or vice versa.

FIGS. 3 to 7 show mixed drying sections, in which at least one two-felted drying group follows several single-felted drying groups which are top felted.

Figure 3:
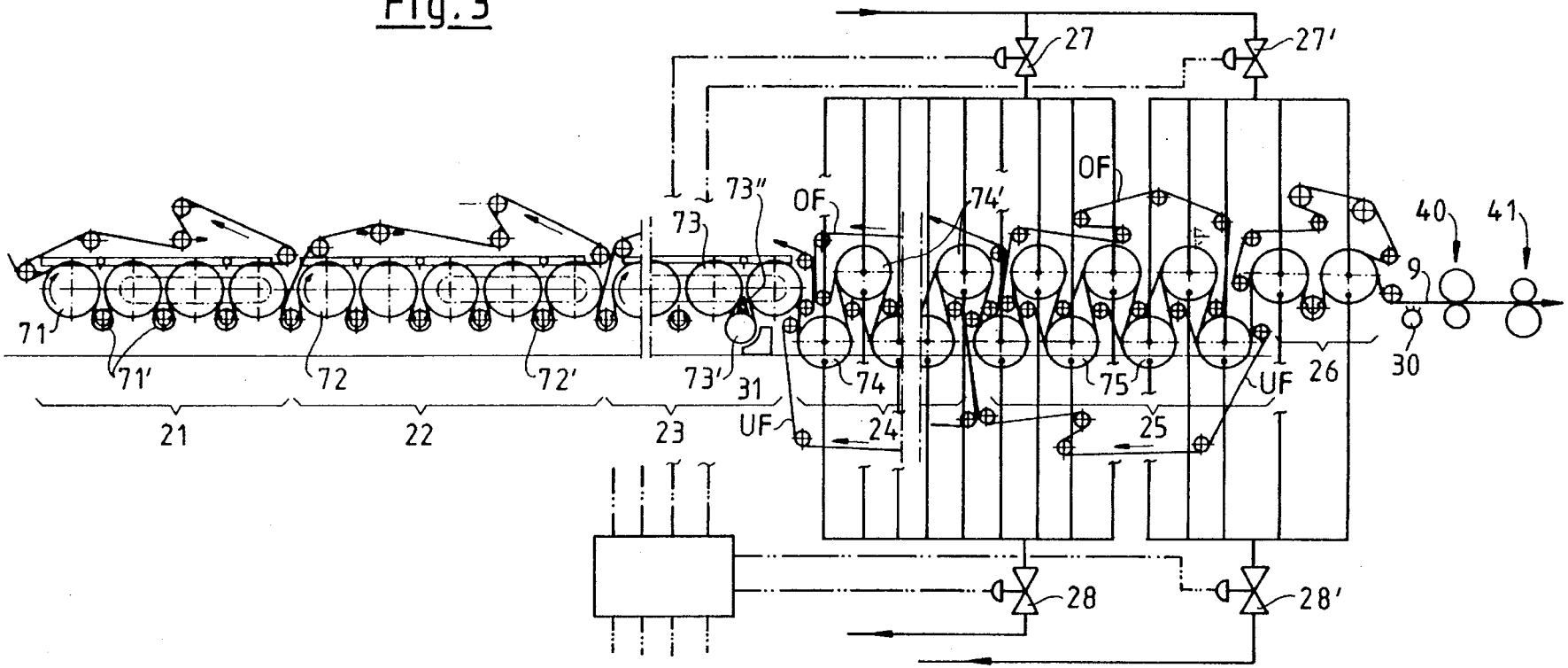

FIG. 3 shows a moistening device (for instance steam blow boxes 31) which are arranged a short distance in front of the transfer from the last single-felt drying group (23) to the following two-felt drying group (24). A further single-felt drying group (26) follows the second two-felt drying group (25). Similar to FIG. 1, a further moistening device 30 may be added between the drying section 21–26 and calenders 40, 41.

In accordance with FIG. 3, the supplying of steam to the upper and lower drying cylinders in the two-felt drying groups is commonly controlled, i.e. by means of a single valve (27, 27') for each heating group (and in the same manner the discharge of the condensate-steam mixture from the cylinders is commonly controlled by means of one common valve 28, 28' for each heating group).

Figure 4:
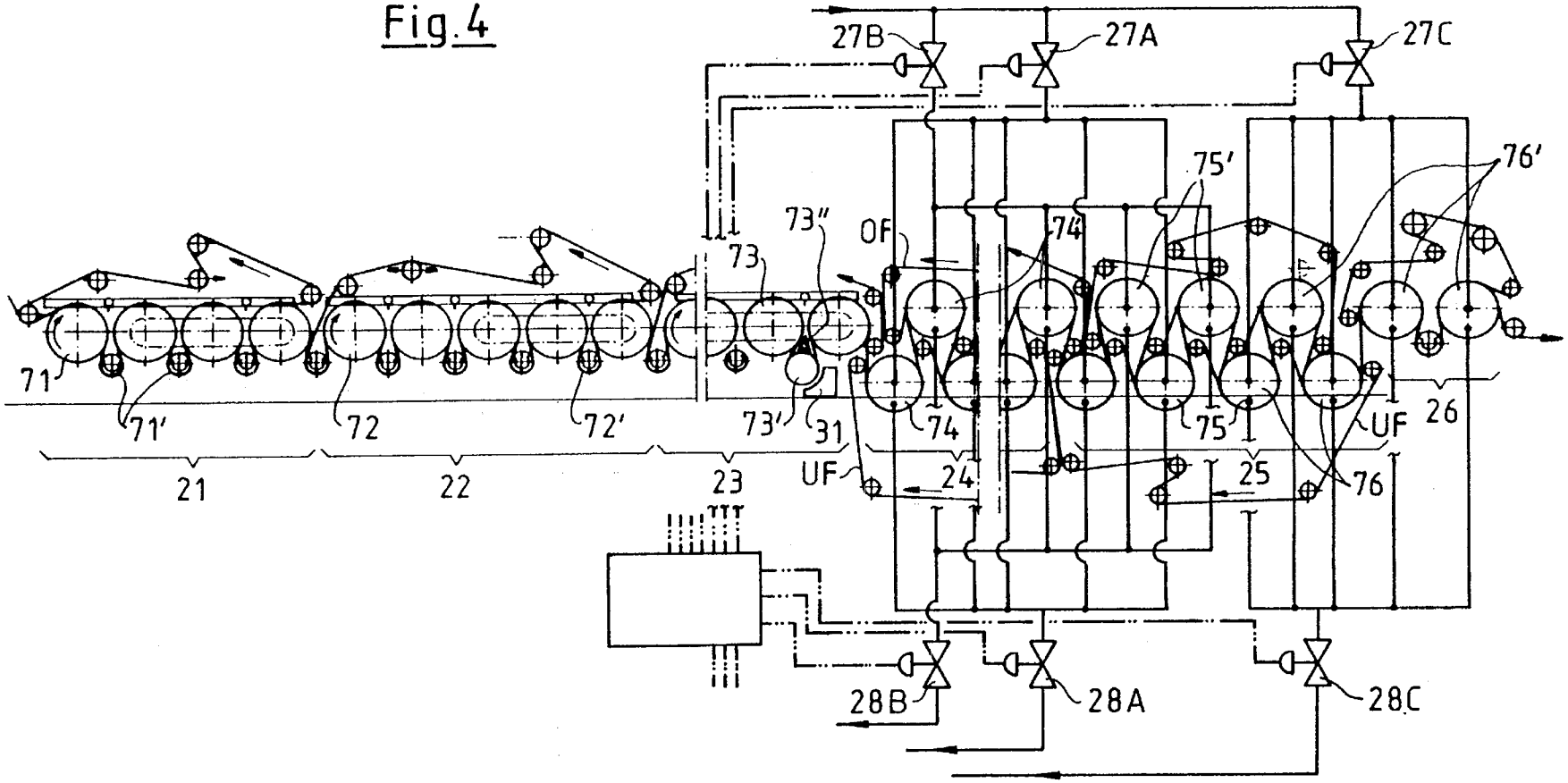

On the other hand, in FIG. 4 in a front upstream region of the two-felt drying groups (24, 25), the feeding of steam to the lower cylinders (74, 75) is controlled (by means of valves 27A and 28A) independently of the feeding of steam to the upper cylinders (74', 75') (by means of valves 27B and 28B). In the rear part of the drying section, on the other hand, steam is uniformly supplied to upper and lower drying cylinders (76' and 76) by means of valves 27C and 28C. In addition, a moistening device (31) can be (if necessary or desired) used.

Both in FIGS. 3 and 4 (see also FIG. 1) the moistening device is positioned to spray water or steam at the paper web, as the paper web traverses one of the transfer guide rolls which are located at the end region of the single tier portion of the paper making machine. An advantage of spraying water or steam at the paper web as it traverses a vacuum roll is that the high suction produced by the vacuum guide rolls serves to draw the moisture deeper into the paper web so that the object to counteract curl can be realized with a lesser amount of water due to the deeper penetration of the water into the paper web. This also affords the possibility of controlling curl by controlling the amount of vacuum supplied inside the vacuum guide roll about which the paper web is being moistened.

Figures 5, 8, 9:
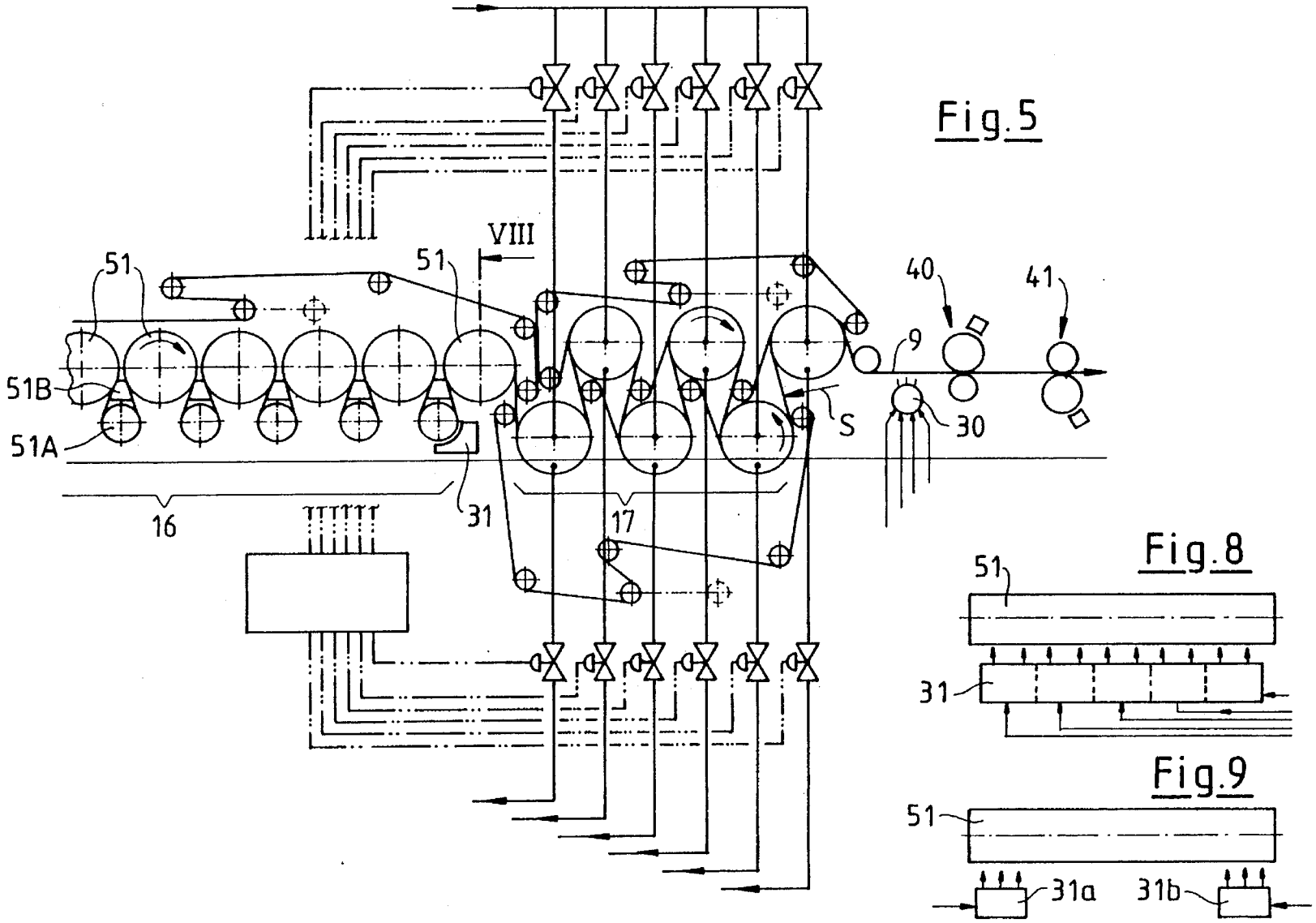
FIGS. 8 and 9 are cross sections along line VIII of FIG. 5.

In accordance with FIG. 5, all guide suction rolls (51A) in the last single-felt drying group (17) are provided with external stationary suction boxes (51B). Such suction rolls (for instance 73', 73") can also be provided in all of the other figures, instead of the suction rolls with inner stationary suction boxes.

As shown in FIG. 5, the feeding of steam to each of the six individual cylinders can be controlled individually in the two-felt drying group (17). As an alternative (not shown), at least one pair of one bottom cylinder and one top cylinder may be added which may be commonly controlled as shown in FIG. 3. Moistening devices 30 and/or 31 may be provided as explained above.

FIG. 8 shows a machine-wide moistening device 31, which may be subdivided into individually controllable zones. FIG. 9 shows an alternative comprising only edge-moistening devices 31*a*, 31*b*.

Figure 6:
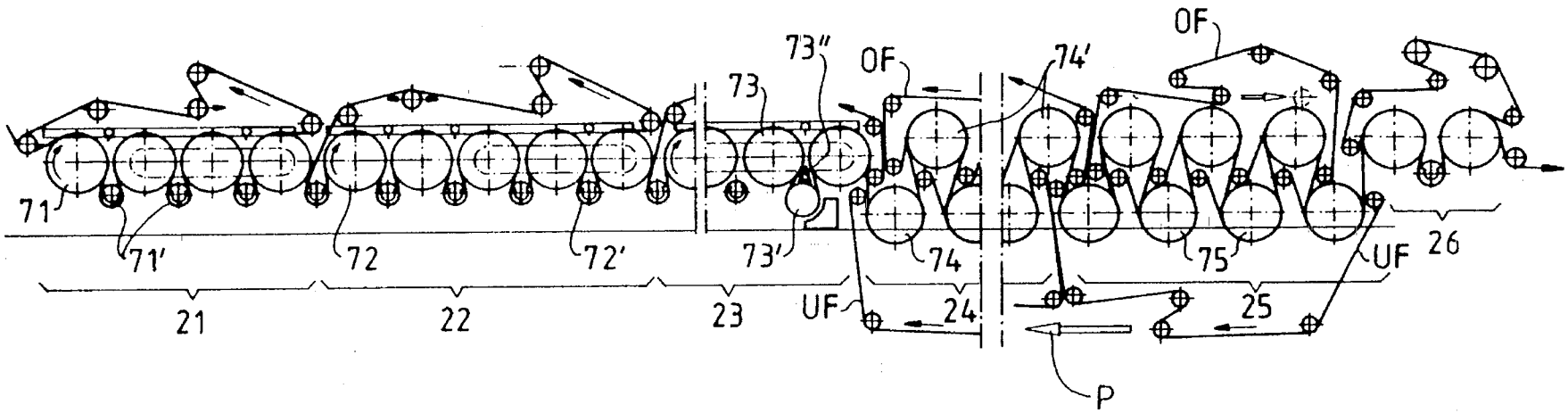

In accordance with FIG. 6, in a two-felt drying group 25 the lengthwise tension of the lower felt UF can be set at a substantially higher value (represented symbolically by the arrow P) than that of the upper felt OF.

Figure 7:
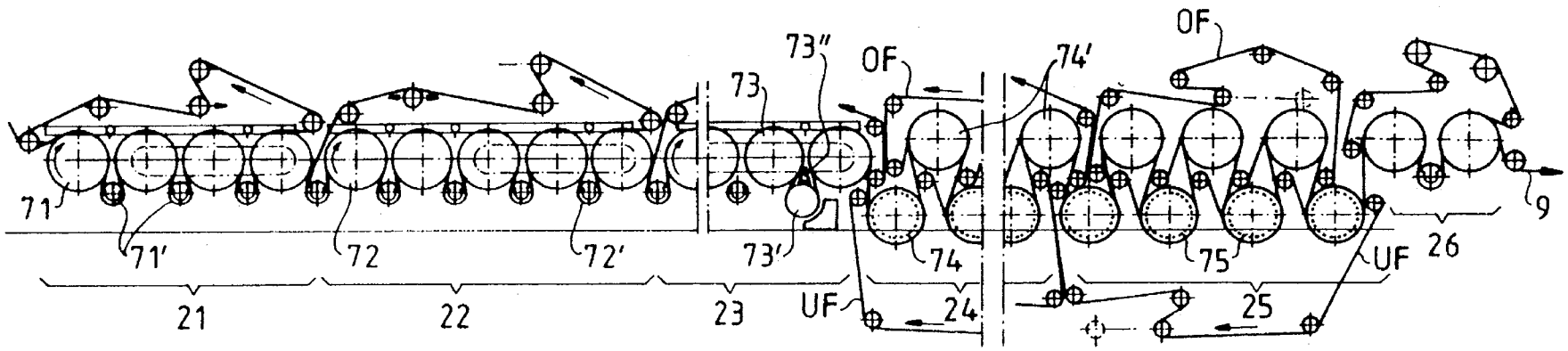

In accordance with FIG. 7, the lower cylinders 74 and 75 of the two-felt drying groups 24 and 25 are provided with condensate-disturbance ledges as represented symbolically by dotted circles.

In FIG. 4, the double-felted dryers are followed by a short single tier dryer group consisting of a pair of dryers 76' and a single vacuum roll.

Figure 10:
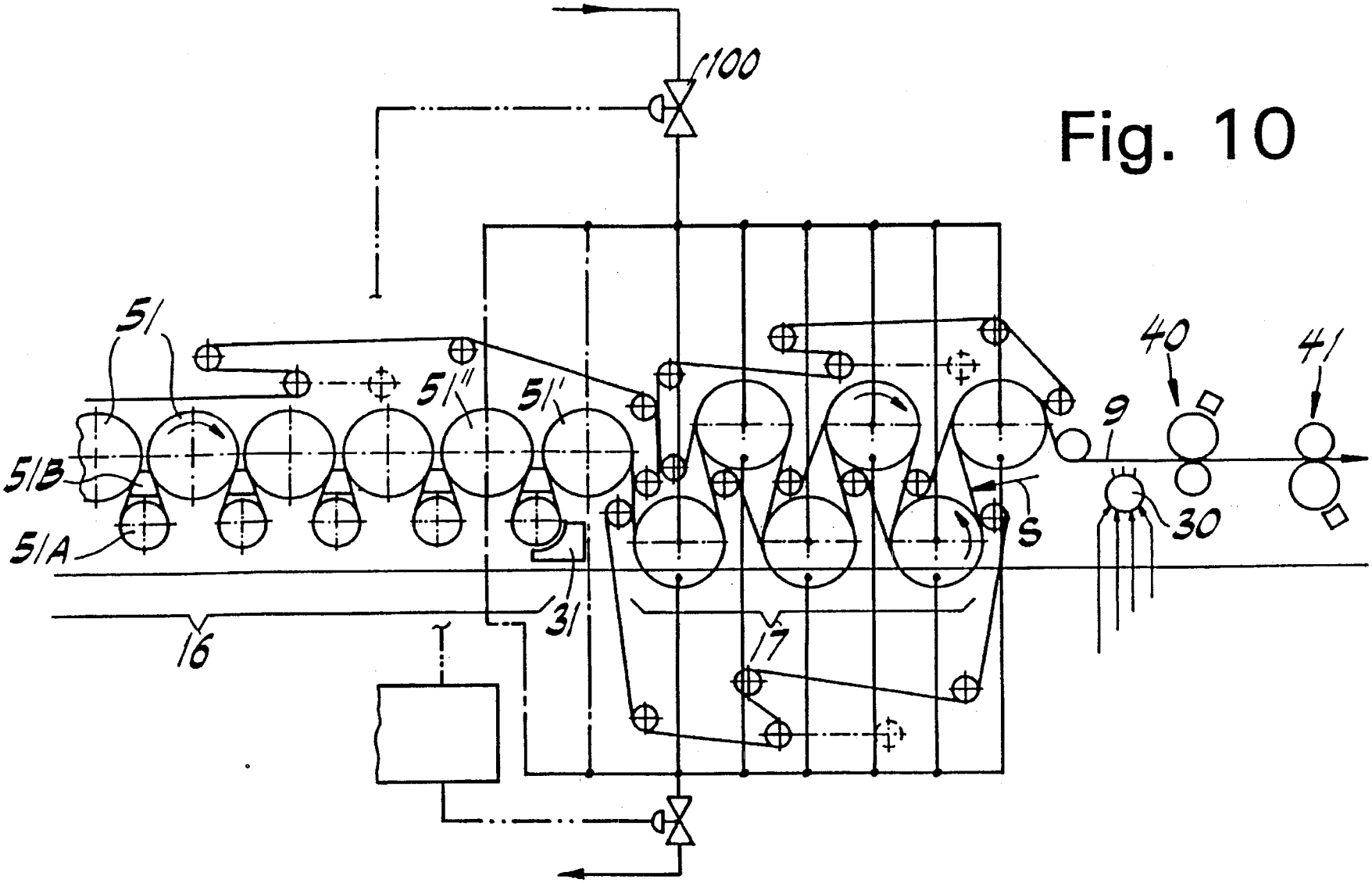
FIG. 10 is a diagrammatic side view of an alternative embodiment of the embodiment shown in FIG. 5.

FIG. 10 illustrates an alternative drying section as compared with that shown in FIG. 5. As discussed above, the feeding of steam to each of the six individual cylinders is controlled individually in the two felt drying group 17 by a plurality of control valves shown in the embodiment shown in FIG. 5.

In the embodiment shown in FIG. 10, the plurality of control valves for individually controlling each of the six individual cylinders in FIG. 5 are replaced with a single control valve 100 which controls all of the six individual cylinders of the drying section 17. Consequently, each of the six cylinders in the drying section 17 has the same steam pressure as the others of the six cylinders. Also, as a result of using only one control valve 100 instead of the plurality of control valves, the drying section shown in FIG. 10 is less expensive and easier to install. As described above, the location of the double tier drying section 17 following the single tier drying section reduces the tendency of the paper web to curl. If more intense curl control is required, one or more moistening devices 30, 31 can be included.

As shown in the dotted or broken lines of FIG. 10, the single control valve 100 can also be operatively connected to one or more of the cylinders of the single tier drying group 16. For example, only one cylinder, the last cylinder 51' of the single tier drying group 16 can be connected to the control valve 100 to be controlled thereby. As a result, the cylinder 51' would have the same steam pressure as each of the six cylinders in the double tier drying group 17.

As also shown by the dotted or broken lines of FIG. 10, the cylinder 51" to the left of the cylinder 51' can also be operatively connected to the control valve 100 to be controlled thereby. In this embodiment, the last two cylinders 51' and 51" of the single tier drying group can be controlled by the control valve 100 so that each cylinder 51', 51" has the same steam pressure has each of the six cylinders in the double tier drying group 17.

Figure 11:
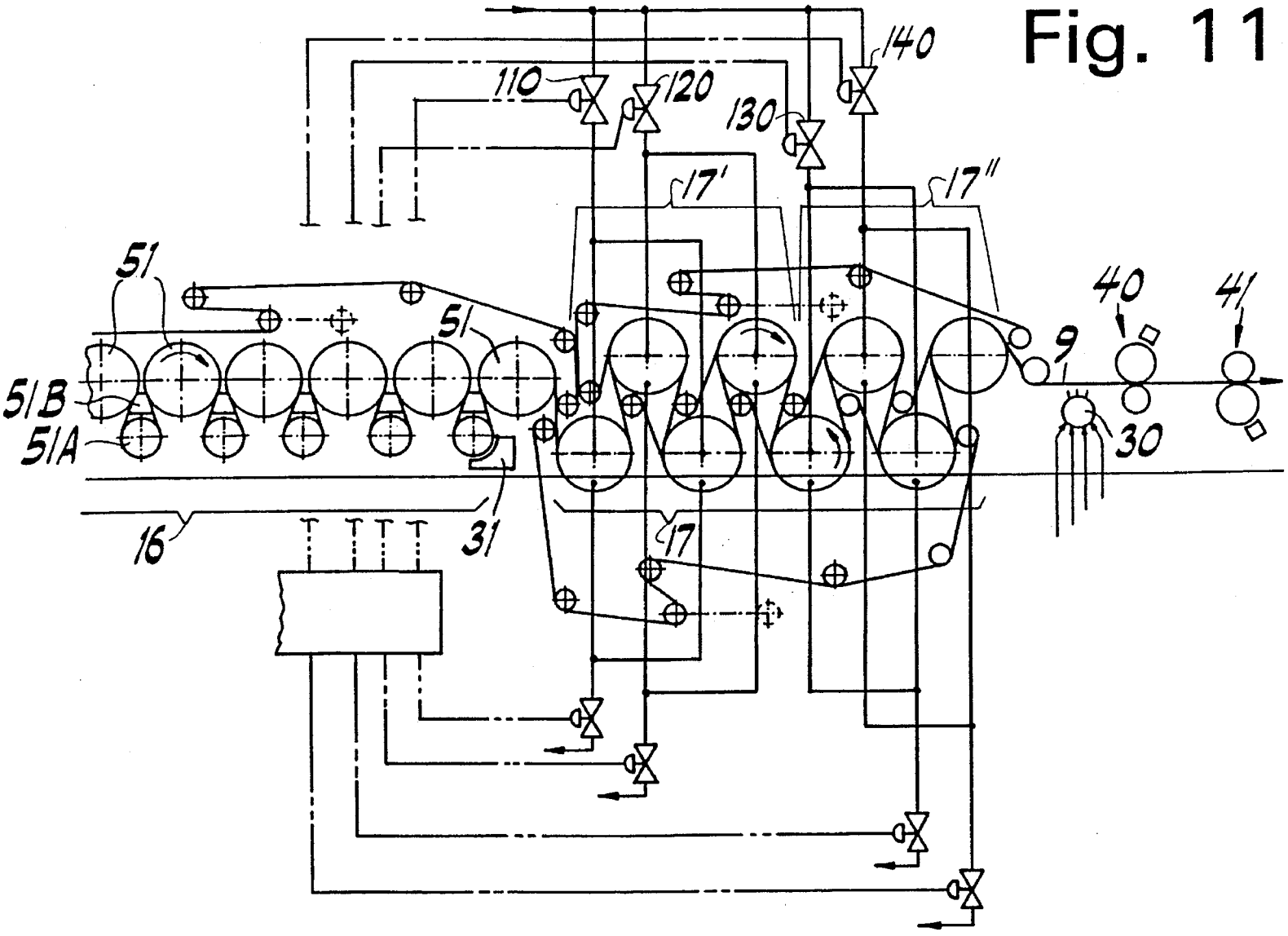
FIG. 11 is a diagrammatic side view of another alternative embodiment of the embodiment shown in FIG. 5.

FIG. 11 illustrates another alternative embodiment of that shown in FIG. 5. Instead of the the plurality of control valves for individually controlling each of the six individual cylinders in FIG. 5, the embodiment in FIG. 11 includes fewer control valves for controlling the steam pressure in the eight cylinders of the drying section 17.

More specifically, the drying section 17 can be divided into at least two drying groups. The first drying group 17' is comprised of the first four cylinders in the drying section 17 and the second drying group 17" is comprised of the last four cylinders in the drying section 17. The lower two cylinders of the first drying group 17' are operatively connected to the control valve 110 and the upper two cylinders of the first drying group 17' are operatively connected to the control valve 120. Thus, the upper cylinders in the first drying group 17' may have a different steam pressure than the lower cylinders of the first drying group 17' to achieve desired curl control.

Similarly, the lower two cylinders of the second drying group 17" are operatively connected to the control valve 130 and the upper two cylinders of the second drying group 17" are operatively connected to the control valve 140. Thus, the upper cylinders in the second drying group 17" may have a different steam pressure than the lower cylinders of the second drying group 17" to achieve desired curl control.

In addition to the possibility for achieving differential steam pressure between the upper and lower cylinders of each of the first and second drying groups 17' and 17", each of the upper and lower cylinders of the first drying group 17' may have a different steam pressure than that of the upper and lower cylinders of the second drying group 17" to achieve even greater curl control.

Figure 12:
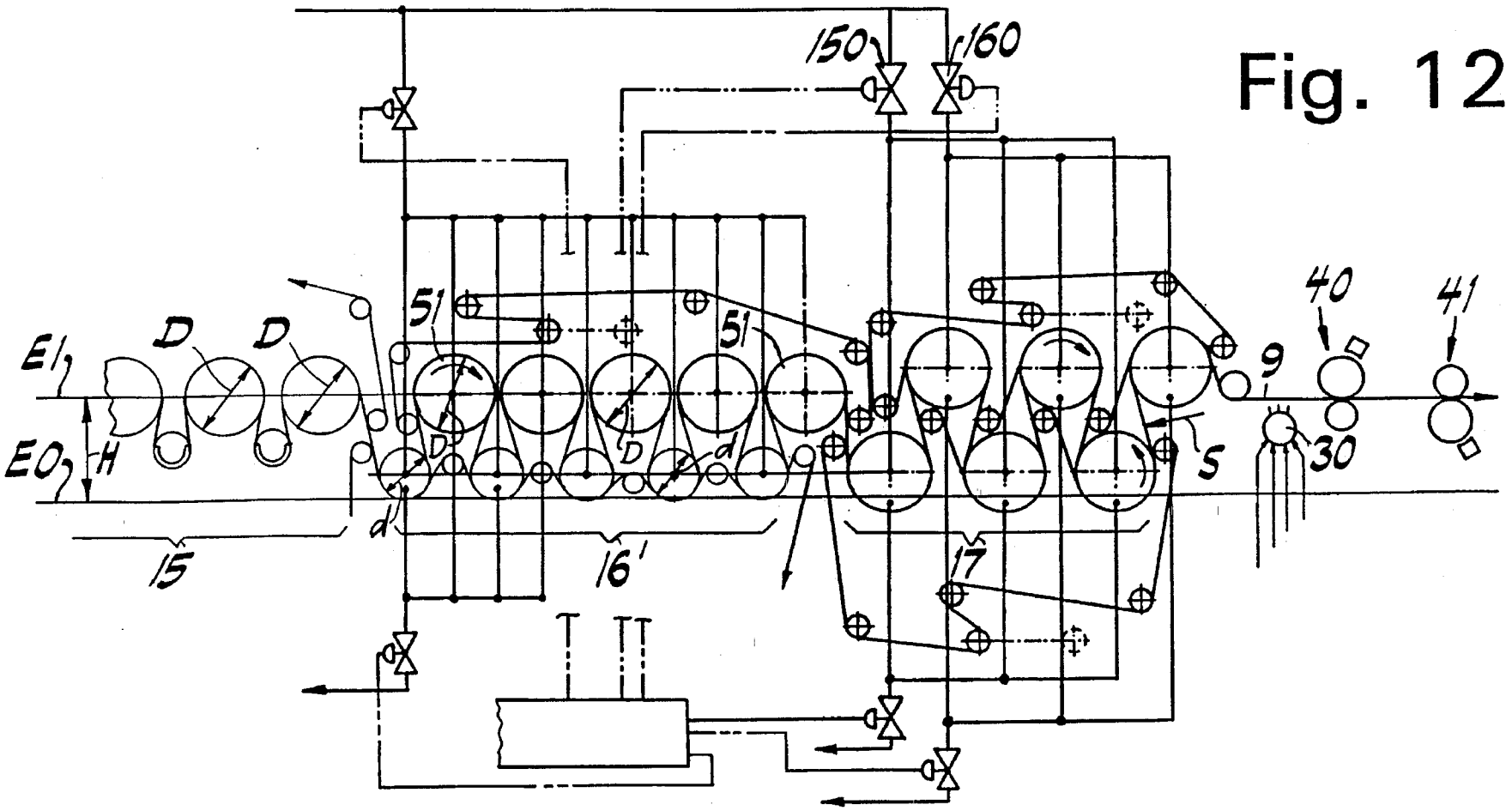
FIG. 12 is a diagrammatic side view of a further embodiment of a drying section including a double-felt drying group.

FIG. 12 illustrates yet another alternative embodiment of the drying section shown in FIG. 5. The single-felt drying group 16 of FIG. 5 is replaced with a double tier, double-felt drying group 16' shown in FIG. 12. The double tier, double-felt drying group 16' increases drying capacity and decreases the tendency for the web to curl.

The embodiment shown in FIG. 12 is also a modification of the embodiment of the invention shown in FIG. 10 of co-pending U.S. patent application No. 08/151,255 filed on Nov. 12, 1993, the disclosure of which is hereby incorporated by reference.

As shown in FIG. 12, the diameter D of the cylinders in the single-felt drying group 15 is substantially equal to the diameter D of the upper cylinders in the double-felt drying group 16'. The lower cylinders of the double-felt drying group 16' have a smaller diameter d than the cylinders in the single-felt drying group 15 and the upper cylinders of the double-felt drying group 16'. The axes of the lower cylinders in the double-felt drying group 16' are aligned with the axes of the lower cylinders in the double-felt drying group 17. The distance H between the horizontal plane E1 and the floor level E0 is about (D/2+d).

The embodiment shown in FIG. 12 also includes two control valves 150 and 160 for controlling steam pressure in the cylinders of the double-felt drying group 17. Similar to the control valves 110–140 shown in FIG. 11, the control valve 150 controls the lower cylinders of the double-felt drying group 17 and the control valve 160 controls the upper cylinders of the double-felt drying group 17. Accordingly, the steam pressure in the lower cylinders of the double-felt drying group 17 can be different from the steam pressure in the upper cylinders in the double-felt drying group 17 to achieve desired curl control.

Figure 13:
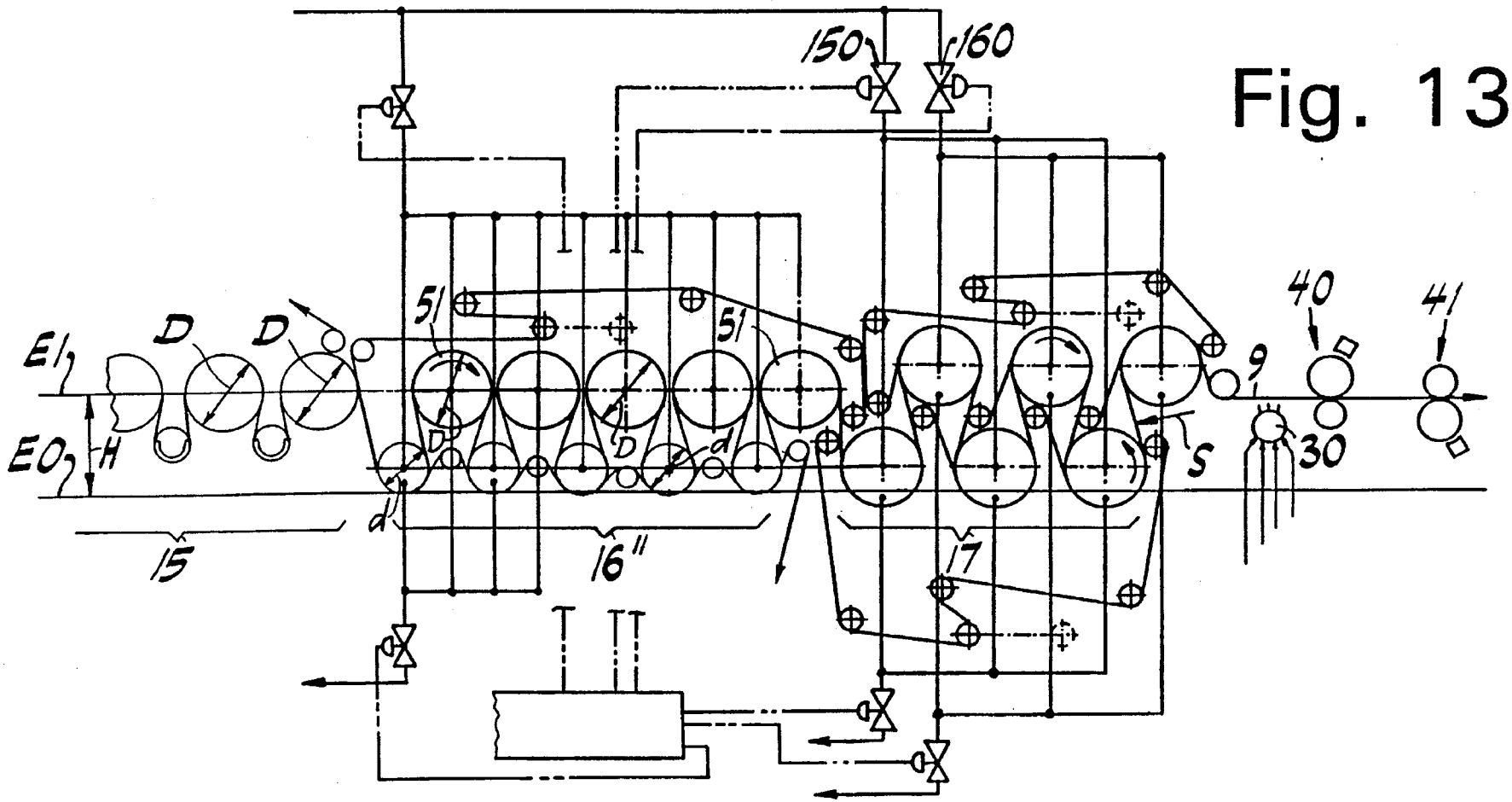
FIG. 13 is a diagrammatic side view of an alternative embodiment of the drying section shown in FIG. 12.

FIG. 13 is an alternative embodiment of the embodiment shown in FIG. 12. The double tier, double-felt drying group 16' of FIG. 12 has been replaced in FIG. 13 by a double tier, single-felt drying group 16". This results in a lower cost than the embodiment shown in FIG. 12 while still providing a desired level of curl control for certain applications.

FIG. 13 also includes the control valves 150, 160 for separately controlling the lower cylinders and upper cylinders, respectively, of the double-felt drying group 17 as described above with reference to the embodiment shown in FIG. 12.

Figure 14:
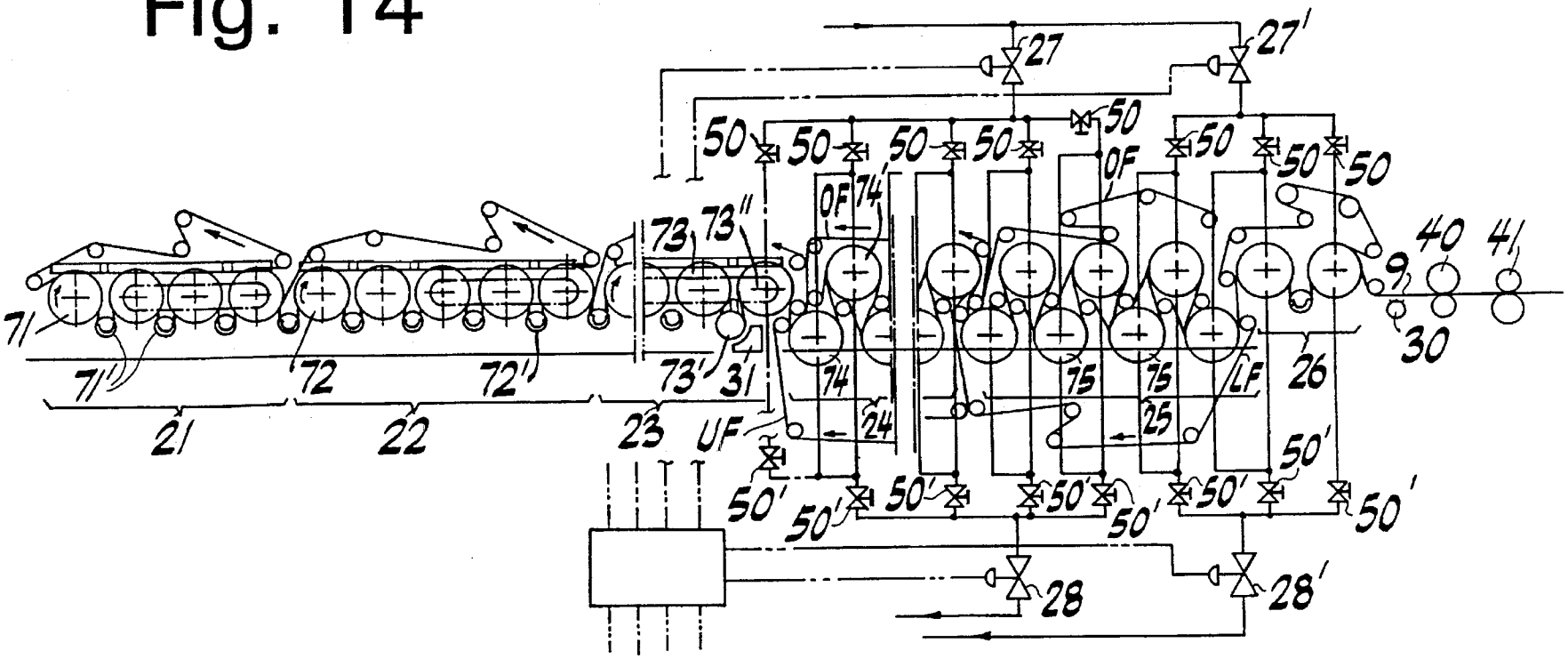
FIG. 14 is a diagrammatic side view of yet another alternative embodiment of the drying section shown in FIG. 5.

FIG. 14 is a further alternative embodiment of FIG. 5. Instead of providing one control valve for each individual cylinder in a drying group 17 as in FIG. 5, the embodiment in FIG. 14 provides two control valves 27 and 27'. The first control valve 27 is provided for controlling the steam pressure in the drying group 24 and the first few cylinders of the drying group 25. The second control valve 27' is provided for controlling the steam pressure in the last few cylinders of the drying group 25 and the cylinders of the drying group 26.

Each set of adjacent upper and lower cylinders in the drying groups 24 and 25 and the adjacent cylinders of the drying group 26 is provided with an isolation valve 50. Each isolation valve 50 is preferably formed to be open or closed, without being able to be partially open by an adjusting device. The isolation valves 50 are connected in steam lines between the control valves 27, 27' and the cylinders of the drying groups 24–26.

If the last cylinder or last few cylinders of the drying group 23 are connected to the control valve 27 (as shown in the dotted or broken line), an additional isolation valve 50 can also be provided between the control valve 27 and the cylinders of the drying group 23.

A plurality of isolation valves 50' are also provided in condensate lines between the cylinders of drying groups 24–26 and the condensate control valves 28, 28'.

In accordance with the embodiment shown in FIG. 14, if one cylinder in any one of the two rows must be shut off during operation of the machine, a corresponding cylinder of the opposing row is automatically shut off simultaneously. This decreases the tendency of the web to curl.

In each of the embodiments shown in FIGS. 10–14, if additional or more intensive curl control is required, one or more of the moistening devices 30, 31, as described above, may be included in the locations shown in FIGS. 10–14.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A drying section for the drying of a paper web in a paper making machine, comprising:

a plurality of heatable drying cylinders for contacting the paper web in each of a plurality of successively located drying groups;

at least in an initial region of the drying section, the drying groups being configured as single-felt drying groups, in which a respective single endless felt and the paper web travel together alternately over the heatable cylinders and over vacuum guide rolls so that one side of the paper web contacts the heatable cylinders;

at least one two-felt drying group located downstream of the single felt drying groups, the at least one two-felt drying group including upper cylinders and lower cylinders;

a single control device for controlling a supply of thermal energy to each of the upper and lower cylinders of the at least one two-felt drying group; and a moistening device provided and located past the drying section for removing or reducing curl developed in the paper web in the drying section.

2. A drying section according to claim 1, wherein said single control device controls the supply of thermal energy to at least a last cylinder of one of the single felt drying groups located adjacent the two-felt drying group.

3. A drying section for the drying of a paper web in a paper making machine, comprising:

a plurality of heatable drying cylinders for contacting the paper web in each of a plurality of successively located drying groups;

at least in an initial region of the drying section, the drying groups being configured as single-felt drying groups, in which a respective single endless felt and the paper web travel together alternately over the heatable cylinders and over vacuum guide rolls so that one side of the paper web contacts the heatable cylinders;

at least one two-felt drying group located downstream of the single felt drying groups, the at least one two-felt drying group including upper cylinders and lower cylinders; and the at least one two-felt drying group comprising at least two heating groups each having a control device for controlling a supply of thermal energy to the cylinders of the respective heating group;

wherein the at least two heating groups are arranged as a pair of heating groups, with one heating group of the pair having upper cylinders and the other heating group of the pair having the lower cylinders; and a moistening device provided and located past the drying section for removing or reducing curl developed in the paper web in the drying section.

4. A drying section according to claim 3, wherein two consecutive pairs of the heating groups are provided.

5. A drying section according to claim 3, further comprising a further heating group including upper and lower cylinders provided upstream of the pair of heating groups.

6. A drying section for the drying of a paper web in a paper making machine, comprising:

a plurality of heatable drying cylinders for contacting the paper web in each of a plurality of successively located drying groups;

at least in an initial region of the drying section, the drying groups being configured as single-felt drying groups, in which a respective single endless felt and the paper web travel together alternately over the heatable cylinders and over vacuum guide rolls so that one side of the paper web contacts the heatable cylinders; and at least one two-felt drying group located downstream of the single felt drying groups, the at least one two-felt drying group including upper cylinders and lower cylinders;

wherein rotation axes of the cylinders of at least one of the single-felt dryer groups lie at least approximately in a horizontal plane that is the same as axes of the upper cylinders of the at least one two-felt dryer group, the cylinders of the at least one single-felt dryer group have the same diameter as diameters of the upper cylinders of the at least one two-felt dryer group; and comprising a double-tier dryer group including upper and lower cylinders and a pair of heating groups, the double-tier dryer group being located downstream of the at least one two-felt drying group.

7. A drying section according to claim 6, wherein each of the lower cylinders of the at least one two-felt drying group have a smaller diameter than a diameter of each of the upper cylinders of the at least one two-felt drying group.

8. A drying section according to claim 6, wherein a diameter of each of the upper cylinders of the at least one two-felt drying group is D and a diameter of each of the lower cylinders of the at least one two-felt drying group is d and a distance between a plane extending along a location of the axes of the upper cylinders of the at least one two-felt drying group and a level of a floor supporting the drying section is equal to about (D/2+d).

9. A drying section for the drying of paper web in a paper making machine, comprising:

a plurality of heatable drying cylinders for contacting the paper web in each of a plurality of successively located drying groups;

at least in an initial region of the drying section, the drying groups being configured as single-felt drying groups, in which a respective single endless felt and the paper web travel together alternately over the heatable cylinders and over vacuum guide rolls so that one side of the paper web contacts the heatable cylinders; and at least one double tier, single-felt drying group located downstream of the single felt drying groups, the at least one double tier, single-felt drying group including upper cylinders and lower cylinders; wherein rotation axes of the cylinders of at least one of the horizontal plane that is the same as axes of the upper cylinders of the at least one double tier, single-felt dryer group, and the cylinders of the at least one single-felt dryer group have the same diameter as diameters of the upper cylinders of the at least one double tier, single-felt dryer group; and comprising a double-tier dryer group including upper and lower cylinders and a pair of heating groups, the double-tier dryer group being located downstream of the at least one double-tier, single-felt drying group.

10. A drying section according to claim 9, wherein each of the lower cylinders of the at least one double tier, single-felt drying group have a smaller diameter than a diameter of each of the upper cylinders of the at least one double tier, single-felt drying group.

11. A drying section according to claim 9, wherein a diameter of each of the upper cylinders of the at least one double tier, single-felt drying group is D and a diameter of each of the lower cylinders of the at least one double tier, single-felt drying group is d and a distance between a plane extending along a location of the axes of the upper cylinders of the at least one double tier, single-felt drying group and a level of a floor supporting the drying section is equal to about (D/2+d).

12. A drying section for the drying of a paper web in a paper making machine, comprising:

a plurality of heatable drying cylinders for contacting the paper web in each of a plurality of successively located drying groups;

at least in an initial region of the drying section, the drying groups being configured as single-felt drying groups, in which a respective single endless felt and the paper web travel together alternately over the heatable cylinders and over vacuum guide rolls so that one side of the paper web contacts the heatable cylinders;

at least one two-felt drying group located downstream of the single felt drying groups, the at least one two-felt drying group including upper cylinders and lower cylinders; and at least one steam control device for supplying steam to the cylinders of the at least one two-felt drying group;

at least one condensate control device for discharging condensate from the cylinders of the at least one two-felt drying group;

a heating group steam control device for controlling a steam supply to a plurality of cylinders forming a heating group;

the heating group being divided into at least two subgroups, each subgroup having a common isolation valve arranged in a steam supply line and having a common isolation valve arranged in a condensate discharge line; and a moistening device provided and located past the drying section for removing or reducing curl developed in the paper web in the drying section.

13. A drying section according to claim 12, wherein at least one of the subgroups comprises one upper cylinder and one lower cylinder.

14. A drying section for the drying of a paper web in a paper making machine, comprising:

a plurality of heatable drying cylinders for contacting the paper web in each of a plurality of successively located drying groups;

at least in an initial region of the drying section, the drying groups being configured as single-felt drying groups, in which a respective single endless felt and the paper web travel together alternately over the heatable cylinders and over vacuum guide rolls so that one side of the paper web contacts the heatable cylinders;

at least one two-felt drying group located downstream of the single felt drying groups, the at least one two-felt drying group including upper cylinders and lower cylinders;

at least one control device for controlling a supply of thermal energy to each of the upper and lower cylinders of the at least one two-felt drying group; and a contactless drying device provided and located past the drying section for removing or reducing curl developed in the paper web in the drying section.

15. A drying section for the drying of a paper web in a paper making machine, comprising:

a plurality of heatable drying cylinders for contacting the paper web in each of a plurality of successively located drying groups;

at least in an initial region of the drying section, the drying groups being configured as single-felt drying groups, in which a respective single endless felt and the paper web travel together alternately over the heatable cylinders and over vacuum guide rolls so that one side of the paper web contacts the heatable cylinders;

at least one two-felt drying group located downstream of the single felt drying groups, the at least one two-felt drying group including upper cylinders and lower cylinders;

at least one control device for controlling a supply of thermal energy to each of the upper and lower cylinders of the at least one two-felt drying group; and a moistening device comprising a water sprayer for rewetting at least one side of the paper web to remove or reduce curl developed in the paper web in the drying section.

* * * * *